US005351489A

United States Patent [19]

Okamoto et al.

[11] Patent Number: 5,351,489

[45] Date of Patent: Oct. 4, 1994

[54] FUEL JETTING NOZZLE ASSEMBLY FOR USE IN GAS TURBINE COMBUSTOR

[75] Inventors: Hiroaki Okamoto; Takahiro Kobayashi, both of Yokohama, Japan

[73] Assignee: Kabushiki Kaisha Toshiba, Kawasaki, Japan

[21] Appl. No.: 996,165

[22] Filed: Dec. 23, 1992

[30] Foreign Application Priority Data

Dec. 24, 1991 [JP] Japan ..... 3-341206

[51] Int. Cl.[5] ..... F23C 5/00

[52] U.S. Cl. ..... 60/740; 60/748; 239/132.5; 239/406

[58] Field of Search ..... 60/740, 748, 737; 239/132.5, 403, 404, 405, 406

[56] References Cited

U.S. PATENT DOCUMENTS

| | | | |
|---|---|---|---|
| 3,570,242 | 3/1971 | Leonardi et al. | 60/737 |
| 3,630,024 | 12/1971 | Hopkins | 60/748 |
| 3,764,071 | 10/1973 | Carlisle | 239/132.5 |
| 3,777,983 | 12/1973 | Hibbins | 239/406 |
| 3,788,067 | 1/1974 | Carlisle et al. . | |
| 4,198,815 | 4/1980 | Bobo et al. | 239/406 |
| 4,726,192 | 2/1988 | Willis et al. | 60/737 |
| 4,825,658 | 5/1989 | Beebe . | |

FOREIGN PATENT DOCUMENTS

| | | |
|---|---|---|
| 0041878 | 12/1981 | European Pat. Off. . |
| 3901232 | 8/1989 | Fed. Rep. of Germany . |
| 1316988 | 12/1962 | France . |
| 79111 | 7/1977 | Japan . |
| 81864 | 5/1987 | Japan . |
| 104818 | 7/1988 | Japan . |
| WO82 02244 | 7/1982 | PCT Int'l Appl. . |
| 2101732 | 1/1983 | United Kingdom . |

*Primary Examiner*—Richard A. Bertsch
*Assistant Examiner*—Timothy S. Thorpe
*Attorney, Agent, or Firm*—Oblon, Spivak, McClelland, Maier & Neustadt

[57] ABSTRACT

A fuel jetting nozzle assembly for use in a gas turbine combustor comprises a nozzle head secured to a head plate, a fuel jetting nozzle secured to the nozzle head and having fuel jetting holes opened to an inside of a combustion chamber, swirling vanes disposed on an outer peripheral portion of the fuel jetting nozzle for supplying air as an annular swirling flow in the combustion chamber of the combustor liner, the fuel jetting holes being formed at base portions of the swirling vanes, and a cooling member composed of a plurality of cooling holes formed to a front end portion of the fuel jetting nozzle so as to introducing a portion of the air into a forward portion of a central portion of the front end portion of the nozzle jetting from an upstream side of the swirling vanes. The cooling member further comprises an air introducing pipe disposed to the front end portion of the fuel jetting nozzle means and an air header attached to an inner surface of the front end portion of the fuel jetting nozzle. The cooling member is substituted by a pipe member formed to the nozzle head for jetting a fuel inside the fuel jetting nozzle and colliding the jetted fuel against an inner surface of the central portion of the front end portion of the fuel jetting nozzle so as to cool the central portion thereof.

1 Claim, 10 Drawing Sheets

FUEL JETTING NOZZLE ASSEMBLY FOR USE IN GAS TURBINE COMBUSTOR

BACKGROUND OF THE INVENTION

The present invention relates to a fuel jetting nozzle assembly for use in a gas turbine combustor, particularly, in which a burn damage to the central portion of the extreme end portion of the fuel jetting nozzle is prevented as much as possible.

FIGS. 9 to 11, explained hereinafter, represents an example of a typical well-known gas turbine combustor of a conventional structure.

Referring to FIGS. 9 to 11, a plurality of gas turbine combustors are arranged on the outer peripheral portion of a discharge casing 2 of an air conditioner 1. A combustor liner 5 by which an internal combustion chamber 4 is enclosed is housed within the combustor casing 3, and a nozzle head 6, an igniter 7 and a flame detector, not shown, are provided in the internal combustion chamber 4. The nozzle head 6 is mounted on a head plate 8, and this head plate 8 and a flow sleeve 9 are mounted on the combustor casing 3. The head plate 8 is disposed so as to close one end of the casing 3.

A fuel jetting nozzle 10 is mounted on the nozzle head 6 and prevented from rotating by a locking plate 11. The combustor liner 5 is mounted on the extreme, i.e. front, end portion of the fuel jetting nozzle 10, and a liner supporter 12 provided on the flow sleeve 9 supports the combustor liner 5.

A transition piece 13 is connected to the extreme end portion (the downstream area) of the combustor liner 5. The combustor liner 5 is connected to a first-stage turbine stationary blade 14*a* of a gas turbine 14 by way of the transition piece 13.

An air intake passage 15 is formed in the outer peripheral portion of the fuel jetting nozzle 10. A swirl vane 16 is disposed between the air intake passage 15 and the internal combustion chamber 4. Fuel jetting holes 17, through which the inside of the fuel jetting nozzle 10 is communicated with the swirl vane 16, are provided on the peripheral wall portion of the fuel jetting nozzle 10.

The front side of a central end portion 18 of the fuel jetting nozzle 10 faces the inside of the internal combustion chamber 4 and forms a portion thereof. A fuel intake 19 is formed in the nozzle head 6, from which a gaseous fuel 20 is introduced into the fuel jetting nozzle 10.

An air flow around the gas turbine combustor will be explained hereunder.

An air 21 discharged from the air conditioner 1 flows around the transition piece 13 and is guided in a direction opposite to the flow of combustion gas 22 between the combustor liner 5 and the flow sleeve 9. The discharged air 21 is introduced into the internal combustion chamber 4 through air passages which are broadly divided into three portions. That is, the discharged air 21 is divided into primary air 23 introduced from the swirl vane 16 around the fuel jetting nozzle 10, secondary air 25 introduced from an air guide 24 provided on the trunk portion of the combustor liner 5, and tertiary air 26 for dilution purposes introduced from the holes provided downstream of the air guide 24 used for the secondary air.

A stable annular vortex area, i.e. flame area, of the primary air 23 and the gaseous fuel 20 is formed in the inside of the annular swirl flow caused by the primary air 23. The stable annular vortex area stabilizes and maintains the combustion flame, and the combustion gas 22 flows to the exit area of the combustor liner 5. The primary air 23 is mixed with the tertiary air 26, and cools the combustor liner 5 and decreases the gas temperature so that the liner exit temperature becomes a temperature required for the turbine.

In this viewpoint, the primary air 23, the secondary air 25 and the tertiary air 26 are allocated in various ways so as to control combustion performance. In some instances, the secondary air 25 and tertiary air 26 may not be provided. Furthermore, the primary air 23 and the secondary air 25 may be mixed with the gaseous fuel 20 beforehand and introduced into the internal combustion chamber 4.

The discharged air 21 passes through a slot, not shown, used to cool the combustor liner 5 and is supplied to the internal combustion chamber 4.

The details of the fuel jetting nozzle 10 are shown in FIG. 10.

Some of the primary air 23 of the discharged air 21 discharged from the air compressor 1 enters from the air intake passage 15 into the internal combustion chamber 4. At this time, the air is mixed with the gaseous fuel 20 jetted from the fuel jetting holes 17, passes the swirl vane 16 disposed around the fuel jetting nozzle 10, is jetted into the internal combustion chamber 4 while it is being swirled and is then ignited. Ignition is performed by the igniter 7 shown in FIG. 9. The combustion gas 22 passes the transition piece 13 and is introduced to the first-stage turbine stationary blade 14a of the gas turbine 14, causing a turbine rotor, not shown, to rotate by using the energy thereof.

The flow of gas near the outlet of the fuel jetting nozzle 10 inside the internal combustion chamber 4 is shown in FIG. 11.

The primary air 23 passes the swirl vanes 16 of the fuel jetting nozzle 10 and flows into the internal combustion chamber 4 while it is being swirled. The secondary air 25 which flows into the internal combustion chamber 4 through the air guide 24 provided in the trunk portion of the combustor liner 5 flows into a swirling flow 27 formed by air passing through the fuel jetting nozzle 10, forming a reverse flow, i.e. vortex flow, flame area 28 in the central portion and a reverse flow, i.e. vortex flow, flame area 29 in the outer periphery. The local temperature of the combustion gas inside the reverse flow flame area 28 in the central portion becomes a high temperature above approximately 2,000° C. and a stable flame can thus be maintained.

However, in the above-described conventional fuel jetting nozzle for use in a gas turbine combustor, problems arise. For example, the central end portion 18 of the fuel jetting nozzle 10 is burned by radiation and forced convection by high-temperature gas of the reverse flow flame area 28 in the central portion, and the service life of the fuel jetting nozzle 10 becomes short.

SUMMARY OF THE INVENTION

An object of the present invention is to substantially eliminate defect or drawbacks encountered in the prior art described above and to provide a fuel jetting nozzle assembly for use in a gas turbine combustor in which service life of the fuel jetting nozzle is lengthened by preventing a burn damage to the central end portion of the jetting nozzle by a location of a cooling means.

This and other objects can be achieved according to the present invention by providing, in one aspect, a fuel jetting nozzle assembly for use in a gas turbine combustor comprising an outer casing, a combustor liner disposed inside the outer casing and having a combustion chamber, a head plate closing one end of the outer casing and a fuel jetting nozzle assembly, the fuel jetting nozzle assembly comprising:

a nozzle head secured to the head plate;

a fuel jetting nozzle means secured to the nozzle head and having fuel jetting holes opened to the inside of the combustion chamber;

a swirling means disposed on an outer peripheral portion of the fuel jetting nozzle means for supplying air as an annular swirling flow in the combustion chamber of the combustor liner, the fuel jetting holes being formed at a base portion of the swirling means; and a cooling means composed of a plurality of cooling holes formed to a front end portion of the fuel jetting nozzle means so as to introduce a portion of the air into a forward portion of a central portion of the front end portion of the nozzle jetting means from an upstream side of the swirling means so as to flow the air into the combustor liner.

The swirling means comprises a plurality of swirling vanes disposed on the outer peripheral portion of the fuel jetting nozzle means and separated equally. The fuel jetting holes are formed at base portions of the swirling vanes, respectively, and each of the cooling holes are positioned between adjacent two fuel jetting holes. Each of the cooling holes has an inward inclination with respect to a front surface of the central portion of the front end portion of the fuel jetting nozzle means, the inward inclination of the cooling hole having a swirling angle component having a same direction as that of a swirling angle of the swirling vane.

The cooling means further comprises an air introducing pipe disposed to the front end portion of the fuel jetting nozzle means and an air header attached to an inner surface of the front end portion of the fuel jetting nozzle means, the air introducing pipe having one end communicated with the air header and another end opened to a discharge air side.

In another aspect of the present invention, there is provided a fuel jetting nozzle assembly for use in a gas turbine combustor comprising an outer casing, a combustor liner disposed inside the outer casing and having a combustion chamber, a head plate closing one end of the outer casing and a fuel jetting nozzle assembly, the fuel jetting nozzle assembly comprising:

a nozzle head secured to the head plate;

a fuel jetting nozzle means secured to the nozzle head and having fuel jetting holes opened to the inside of the combustion chamber;

a swirling means disposed on an outer peripheral portion of the fuel jetting nozzle means for supplying air as an annular swirling flow in the combustion chamber of the combustor liner, the fuel jetting holes being formed at a base portion of the swirling means; and a cooling means formed to the nozzle head for jetting a fuel inside the fuel jetting nozzle means and colliding the jetted fuel against an inner surface of the central portion of the front end portion of the fuel jetting nozzle means so as to cool the central portion thereof.

The cooling means comprises a pipe having one end communicated with the nozzle head and another end opened in the fuel jetting nozzle means. Another end of the pipe is formed with a plurality of fuel jetting holes.

A coating is applied to the front surface of the central portion of the front end portion of the fuel jetting nozzle means with a substance having a coefficient of thermal conductivity lower than that of a substance constituting the fuel jetting nozzle means.

According to the present invention constructed as described above, the central end portion of the fuel jetting nozzle is cooled by the forced convection of air which passes through cooling holes and the air is introduced to the front side thereof. The central end portion of the fuel jetting nozzle can be cooled by an air layer formed by that air in the central end portion of the fuel jetting nozzle. As a result, a burn damage to the fuel jetting nozzle can be prevented.

Furthermore according to the present invention, the high-temperature portion of the central end portion of the fuel jetting nozzle can be cooled by the forced convection using colliding jets caused by a gaseous fuel which is introduced by the cooling means. As a result, the burn damage to the fuel jetting nozzle can be prevented.

BRIEF DESCRIPTION OF THE DRAWINGS

For a better understanding of the present invention and to show how the same is carried out, reference will be made, by way of preferred embodiments, to the accompanying drawings, in which.

DESCRIPTION OF THE PREFERRED EMBODIMENTS

Embodiments of the present invention will be explained hereunder with reference to FIGS. 1 to 8.

Figure 9:
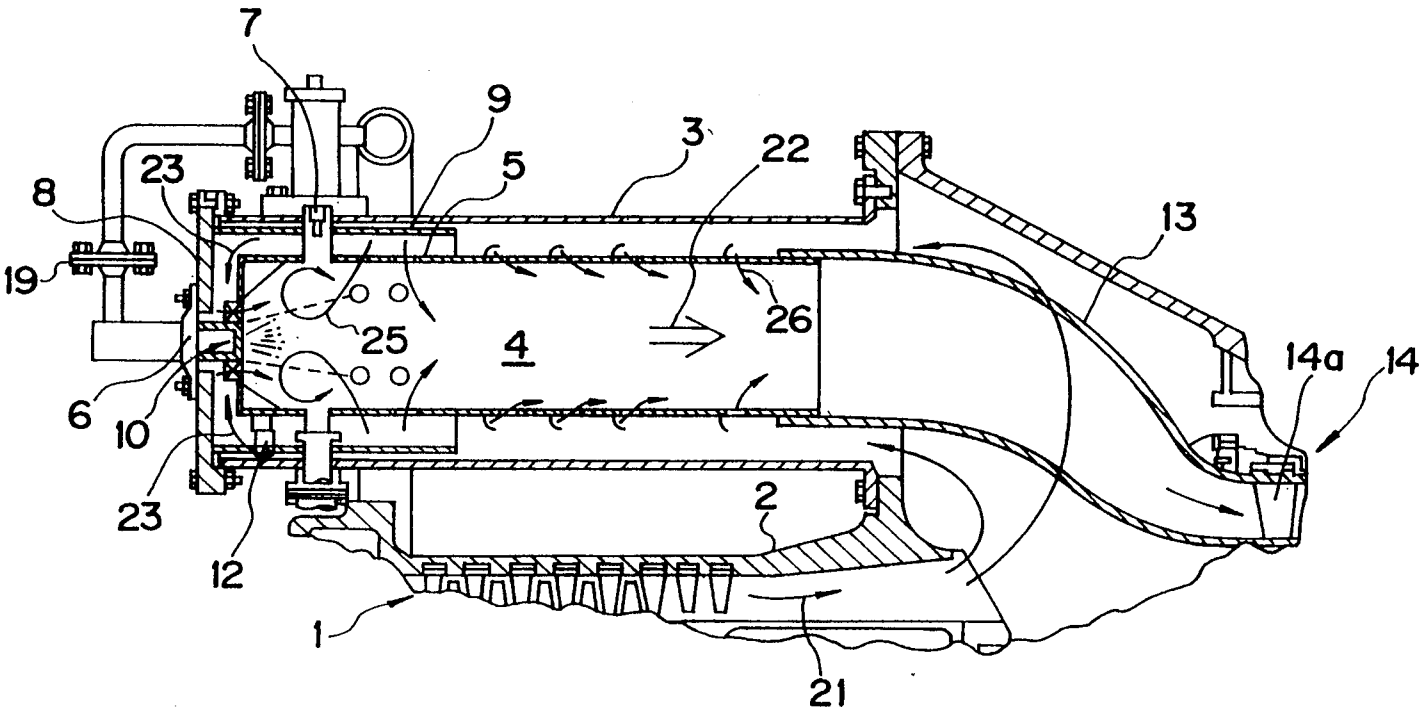
FIG. 9 PRIOR ART
FIG. 9 is a sectional view illustrating a conventional gas turbine combustor.
Figure 10:
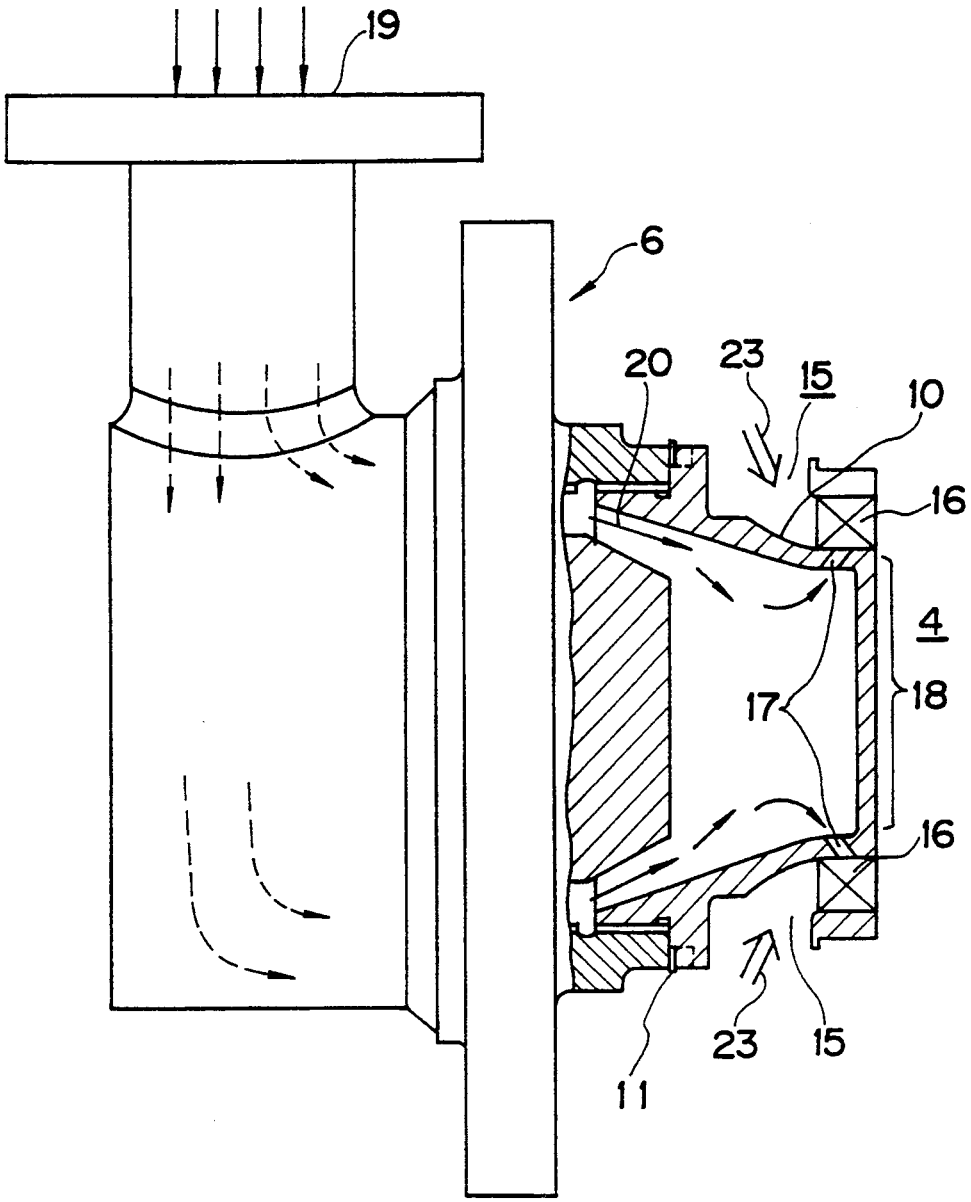
FIG. 10 PRIOR ART
FIG. 10 is an expanded view of the essential portion of the fuel jetting nozzle provided in the gas turbine combustor shown in FIG. 9.
Figure 11:
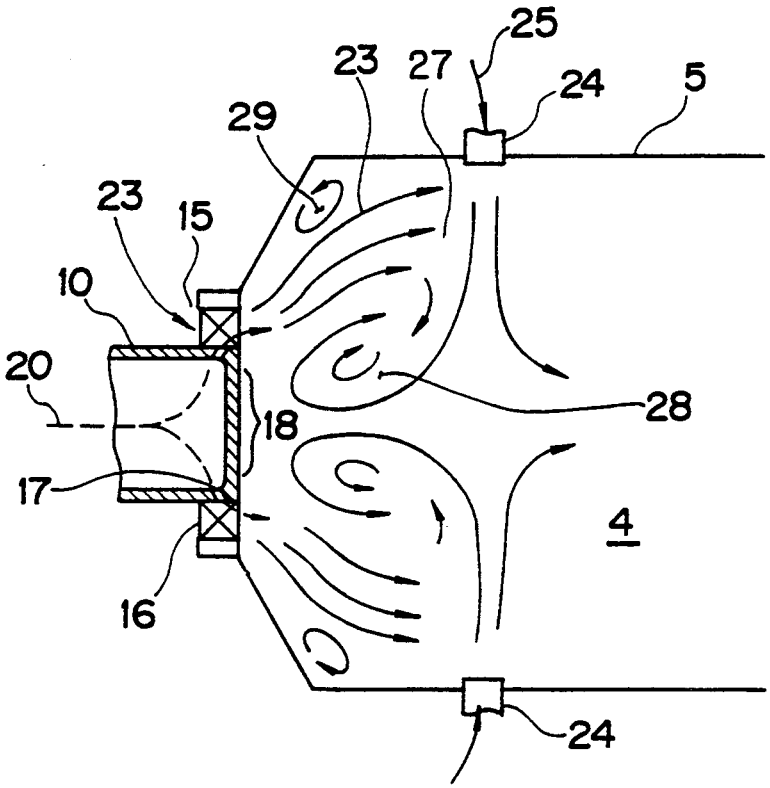
FIG. 11 PRIOR ART
FIG. 11 is a view illustrating the relationship between the swirl flow inside the combustion chamber of the conventional fuel jetting nozzle and the flow of the secondary air.

FIGS. 1 to 4 illustrate a first embodiment of a fuel jetting nozzle assembly for use in a gas turbine combustor according to the present invention. Components which are the same as those in a conventional fuel jetting nozzle assembly shown in FIGS. 9 to 11 are given the same reference numerals, and thus an explanation thereof is omitted herein.

A basic difference of the fuel jetting nozzle of the present invention from the conventional one is that a plurality of swirl vanes 16 by which fuel air is made to flow into the internal combustion chamber 4 are evenly arranged circumferentially on the outer peripheral portion of the fuel jetting nozzle 10, and that fuel jetting holes 17 are provided on the base portions of the swirl vanes 16. The fuel jetting nozzle 10 is fastened to the nozzle head 6 having the fuel intake 19. Each of cooling holes 30, formed at the base portions of the respective swirl vanes 16 and positioned between the adjacent two fuel jetting holes 17, which reaches the front of the central portion 18 of the front end portion of the fuel jetting nozzle 10 from an area upstream of the swirl vanes 16, is provided on the peripheral wall of the fuel jetting nozzle 10.

Figure 1:
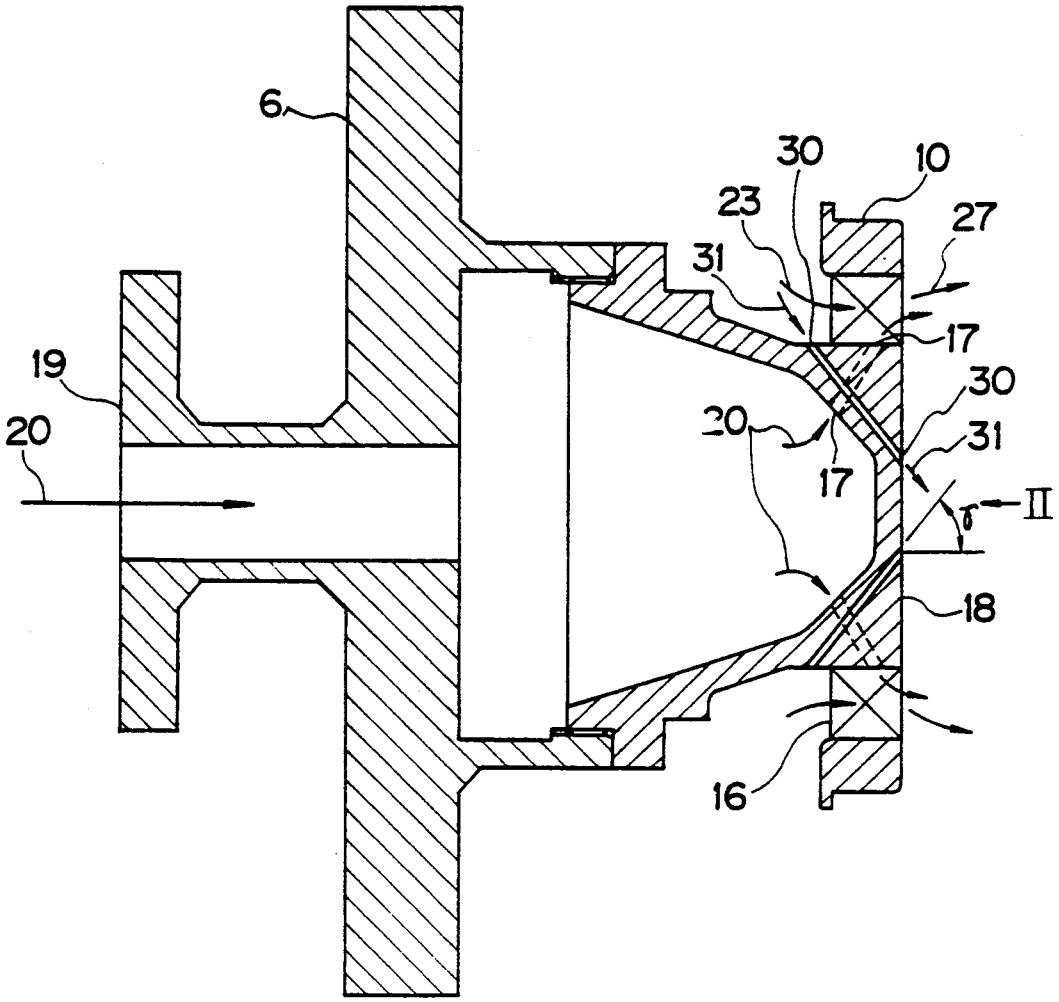
FIG. 1 is a sectional view, taken along the line I—I shown in FIG. 2, mentioned below, illustrating a first embodiment of a fuel jetting nozzle assembly for use in a gas turbine combustor according to the present invention.
Figure 2:
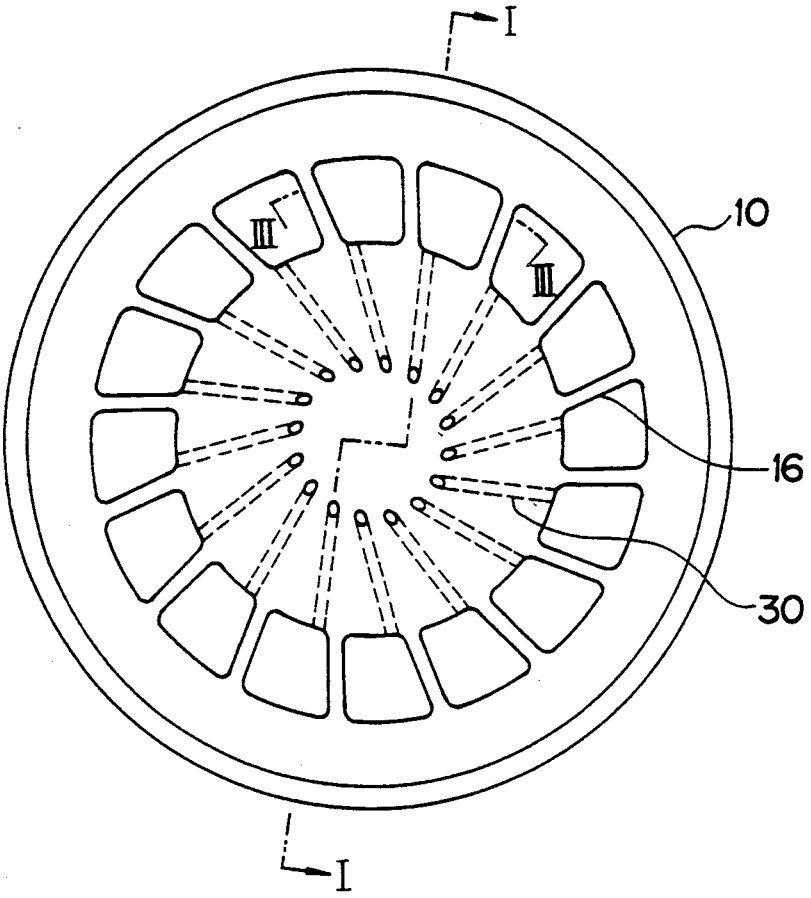
FIG. 2 is a view of the fuel jetting nozzle assembly for use in the gas turbine combustor shown in FIG. 1 taken in the direction of the arrow II in FIG. 1.
Figure 3:
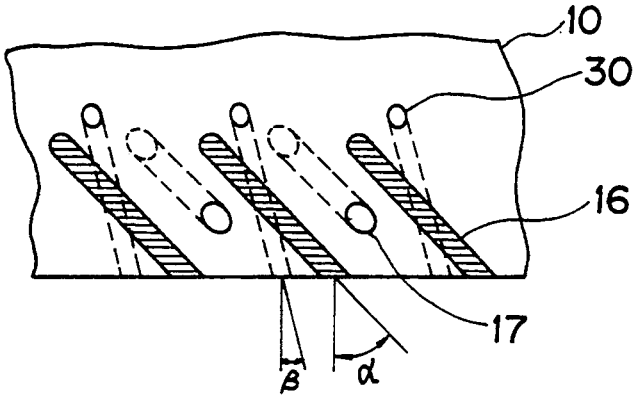
FIG. 3 is a sectional view taken along the line III—III of FIG. 2.

Each of the cooling holes 30 is provided with an inward angle $\gamma$ with respect to the front side of the central end portion 18 of the fuel jetting nozzle 10. As shown in FIG. 3, it has a swirl angle component $\beta$ in the same direction as that of the swirl angle $\alpha$ of the swirl vanes 16.

Figure 4:
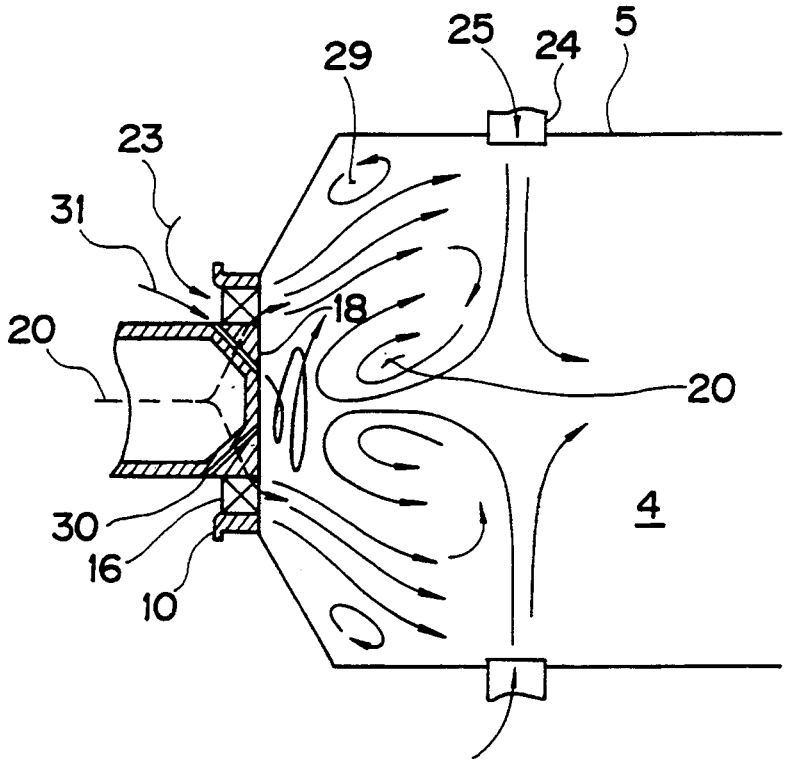
FIG. 4 is a view illustrating the relationship between the swirl flow inside the combustion chamber of the fuel jetting nozzle assembly for use in a gas turbine combustor and the flow of the secondary air.

The operation of this embodiment will be explained hereunder with reference to FIG. 4.

Some of the air 21, discharged from the air compressor 1, passes the swirl vanes 16 as the primary air 23, becomes an annular swirl flow and flows into the internal combustion chamber 4. As a result, a reverse flow, i.e. vortex flow, flame area 28 is formed in the central portion.

At the same time, some of the discharged air 21 flows into the cooling holes 30 as cooling air 31. This cooling air 31 flows out to the front side of the central flame area 28 while it takes away heat by forced convection cooling, which heat flows in from the front side of the fuel jetting nozzle 10. The air flown out to the front side of the central flame area 28 forms an air layer in front of the central end portion 18 of the fuel jetting nozzle 10. Thus, the front side is protected from fuel gas by film-cooling effect.

More particularly, since the cooling hole 30 is provided with a swirl angle component $\beta$ in the same direction as the swirl angle of the swirl vane 16 and also with an inward angle $\gamma$, the cooling air 31 is expanded on the front side of the central end portion 18 of the fuel jetting nozzle 10 while it is being swirled. As a result, a high film-cooling effect can be attained.

According to this embodiment, as described above, the central end portion 18 of the fuel jetting nozzle 10 can be cooled by the forced convection using the cooling air 31 passing through the cooling holes 30 and by the film-cooling effect using an air layer. As a result, a burn damage to the central end portion 18 of the fuel jetting nozzle 10 can be prevented.

Figure 5:
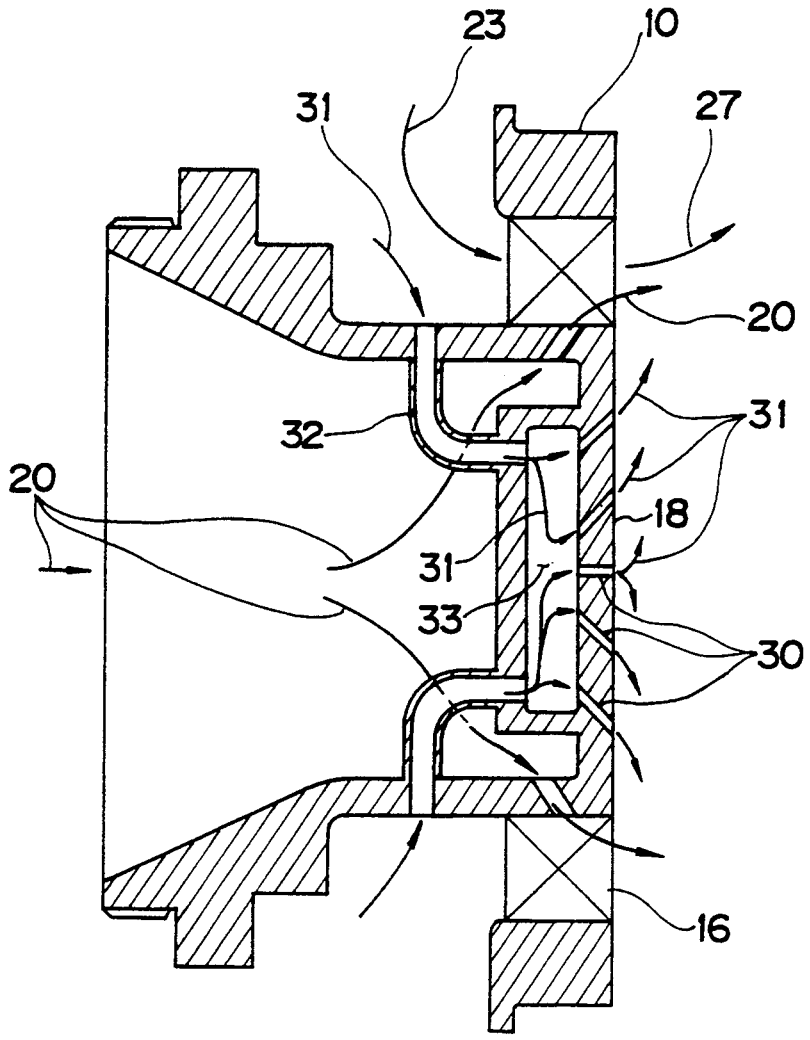
FIG. 5 is a sectional view illustrating a second embodiment of the present invention.

FIG. 5 illustrates a second embodiment of a fuel jetting nozzle for use in a gas turbine combustor according to the present invention. A point of difference of this embodiment from the fuel jetting nozzle explained in the first embodiment is that a pipe 32 and an air header 33 are provided, and that when once some of the discharged air 21 is introduced by the pipe 32 as the cooling air 31 into the air header 33, the air is made to flow out from the inside of the header to the front side of the central end portion 18 of the fuel jetting nozzle 10 through a plurality of cooling holes 30. The air introducing pipe 32 is mounted to the front end portion of the fuel jetting nozzle and the air header 33 is attached to an inner surface of the front end portion of the fuel jetting nozzle, the air introducing pipe 32 having one end communicated with the air header 33 and another end opened to a discharge air side.

According to this embodiment, since the cooling holes 30 can be compactly arranged as desired, a minimum amount of cooling air required can be allocated on the basis of the distribution of the amount of heat which enters from the gaseous fuel 20 into the fuel jetting nozzle 10. Thus, the front side of the central end portion 18 of the fuel jetting nozzle 10 can be cooled more uniformly.

Figure 6:
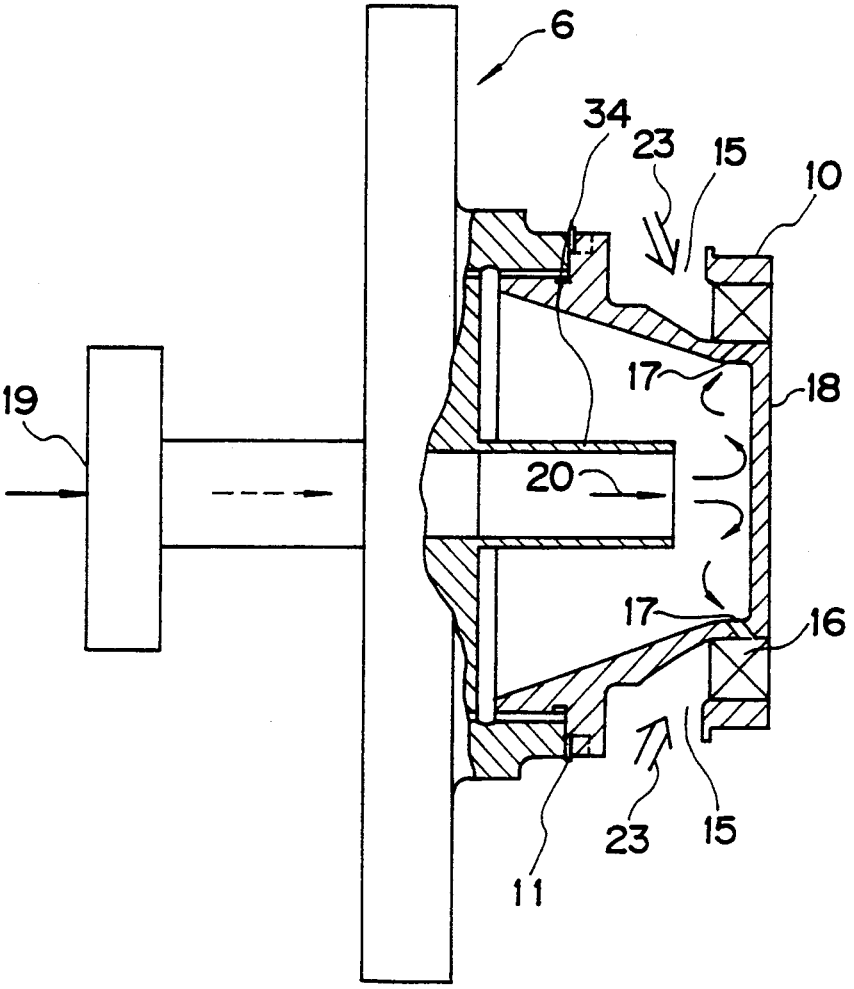
FIG. 6 is a sectional view illustrating a third embodiment of the present invention.

FIG. 6 illustrates a third embodiment of a fuel jetting nozzle for use in a gas turbine combustor according to the present invention. A plurality of swirl vanes 16 by which fuel air is made to flow in are evenly arranged circumferentially on the outer peripheral portion of the fuel jetting nozzle 10, and fuel jetting holes 17 are provided on the base portions of the swirl vanes 16. This is fastened to the nozzle head 6 having the fuel intake 19. A pipe 34, serving as cooling means, for introducing the gaseous fuel 20 to the inner side of the central end portion 18 of the fuel jetting nozzle 10 is disposed in the central portion. The pipe 34 has one end communicated with the nozzle head and another end opened in the fuel jetting nozzle 10.

In this embodiment, some of the discharged air 21 discharged from the air compressor 1, as shown in FIG. 9, flows into the internal combustion chamber 4 from the air intake passage 15 as the primary air 23. The gaseous fuel 20 flows in from the fuel intake 19, passes through the pipe 34, flows out into the fuel jetting nozzle 10 in the form of jets, and collides with the inner side of the central end portion 18, thereby cooling this portion by the forced convection. Thereafter, the gaseous fuel 20 is jetted from the fuel jetting holes 17, mixed with the primary air 23, passes the swirl vanes 16 provided in the periphery of the fuel jetting nozzle 10, and flows out as an annular swirl flow into the internal combustion chamber 4, forming the central reverse flow flame area 28.

Figure 7:
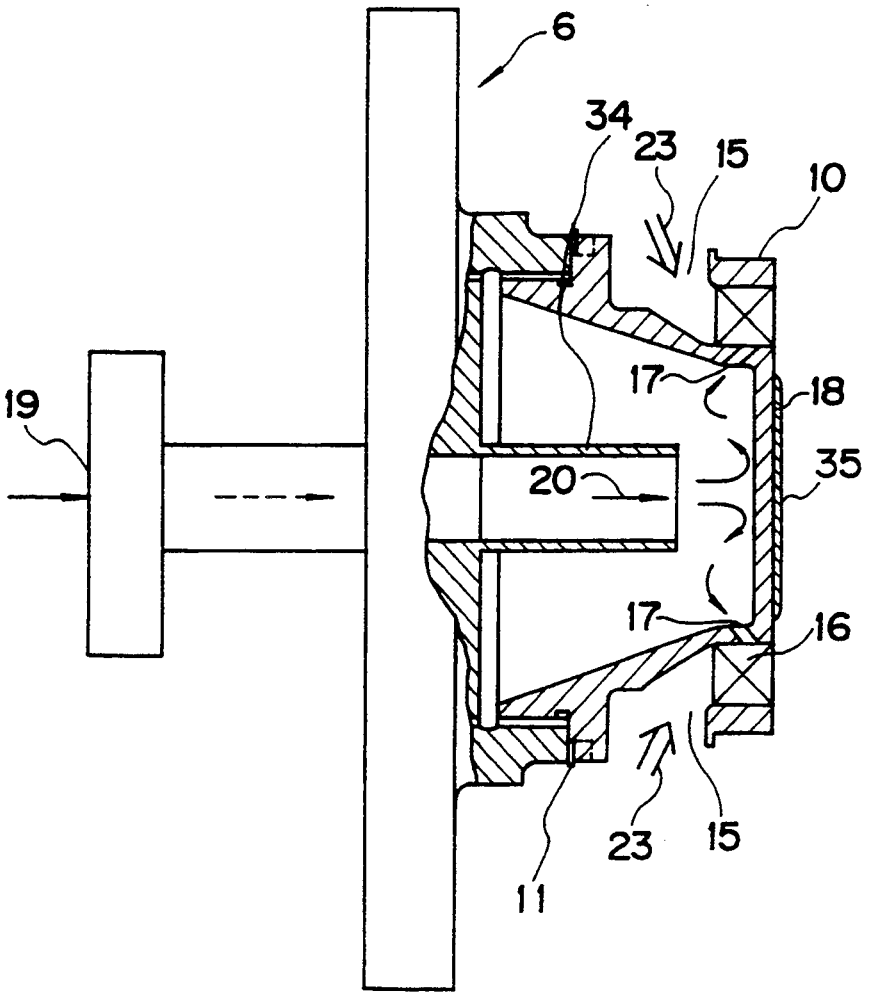
FIG. 7 is a sectional view illustrating a modification of FIG. 6.

As shown in FIG. 7, when the forced convection cooling is performed by making the gaseous fuel 20 collide with the inner side of the central end portion 18 of the fuel jetting nozzle 10, the front side of the central end portion 18 of the fuel jetting nozzle 10 may be coated (thermal barrier coating) with a material 35, such as zirconium oxide, having thermal conductivity lower than that of component metals of the fuel jetting nozzle 10 in order to reduce thermal stress caused by a temperature difference with the inside of the combustion chamber 4.

According to this embodiment, as described above, since the inner side of the central end portion 18 of the fuel jetting nozzle 10 can be cooled by the forced convection using the gaseous fuel 20, a burn damage to the fuel jetting nozzle 10 can be prevented.

Figure 8:
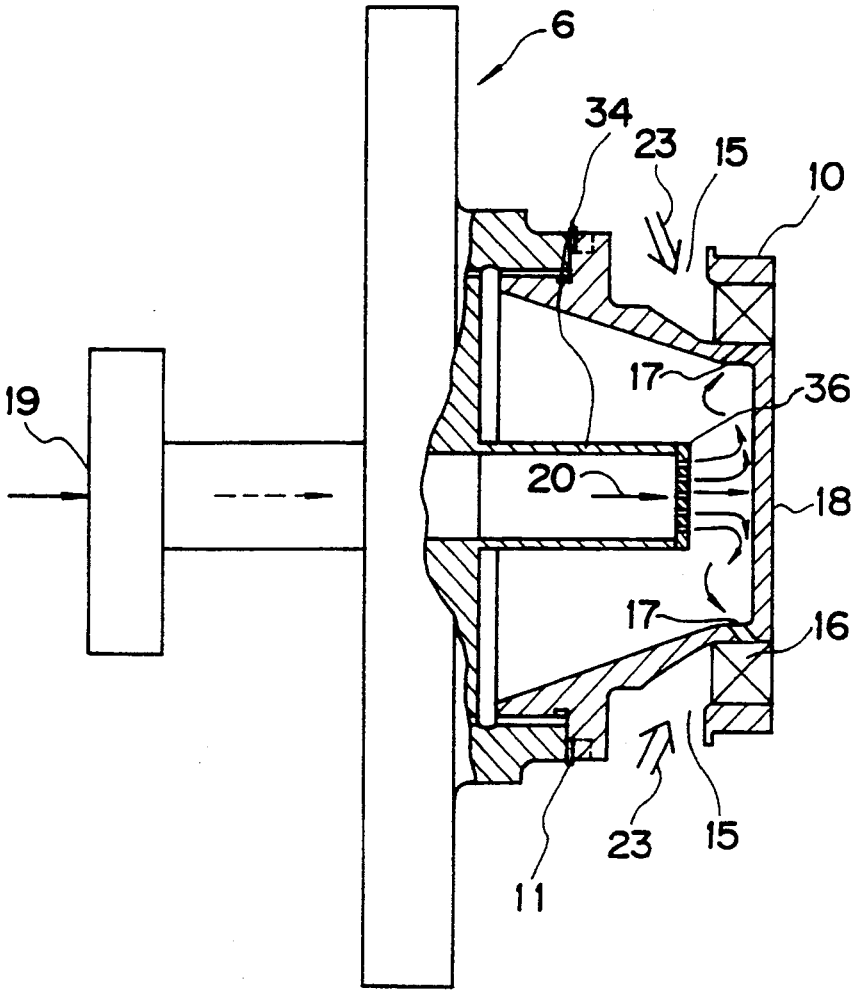
FIG. 8 is a sectional view illustrating another modification of FIG. 6.

In addition, as shown in FIG. 8, a porous plate 36 may be provided in the extreme end portion of the pipe 34 serving as cooling means to make it possible to cool the inner side of the central end portion 18 of the fuel jetting nozzle 10 by a plurality of colliding jets.

What is claimed is:

1. A fuel jetting nozzle assembly for use in a gas turbine combustor comprising an outer casing, a combustor liner disposed inside the outer casing and having a combustion chamber, a head plate closing one end of the outer casing and a fuel jetting nozzle assembly, said fuel jetting nozzle assembly comprising:

a nozzle head secured to the head plate;

a fuel jetting nozzle means secured to the nozzle head and having fuel jetting holes opened to an inside of the combustion chamber;

a swirling means disposed on an outer peripheral portion of the fuel jetting nozzle means for supplying air as an annular swirling flow in the combustion chamber of the combustor liner, said swirling means comprising a base body and a plurality of swirling vanes integrally disposed on the base body and separated equally, said fuel jetting holes being formed at the base body of the swirling means; and a cooling means formed at a front jetting end portion of the fuel jetting nozzle means so as to introduce a portion of the air into a forward portion of a central portion of the front jetting end portion of the nozzle jetting means from an upstream side, with respect to an air flow direction, of the swirling means so as to flow the air into the combustor liner, said cooling means being composed of a plurality of cooling holes;

wherein said fuel jetting holes are formed at the base body for the swirling vanes and each of said cooling holes is positioned between two adjacent fuel jetting holes, each of said cooling holes having an inward inclination with respect to a front surface of the central portion of the front jetting end portion of the fuel jetting nozzle means, said inward inclination of the cooling hole having a swirling angle component having a same direction as that of an inclination of each of the swirling vanes for causing swirling flow, and the base body of the swirling means having an upstream side front surface constituting a boundary wall structure between the combustion gas and the fuel.

* * * * *